United States Patent [19]

Honeycutt

[11] Patent Number: 4,896,715

[45] Date of Patent: Jan. 30, 1990

[54] APPARATUS FOR AND PROCESS OF DIRECT CASTING OF METAL STRIP

[75] Inventor: LeRoy Honeycutt, Salisbury, N.C.

[73] Assignee: National Aluminum Corporation, Pittsburgh, Pa.

[21] Appl. No.: 344,288

[22] PCT Filed: Dec. 29, 1988

[86] PCT No.: PCT/US88/04641

§ 371 Date: Mar. 29, 1989

§ 102(e) Date: Mar. 29, 1989

Related U.S. Application Data

[63] Continuation-in-part of Ser. No. 152,486, Feb. 5, 1988, abandoned.

[51] Int. Cl.[4] ..... B22D 11/06

[52] U.S. Cl. ..... 164/479

[58] Field of Search ..... 164/428, 480, 429, 479

[56] References Cited

FOREIGN PATENT DOCUMENTS 59-13551 1/1984 Japan ..... 164/429

*Primary Examiner*—Kuang Y. Lin

*Attorney, Agent, or Firm*—O'Neil and Bean

[57] ABSTRACT

A melt drag metal strip casting system of the type wherein molten metal is delivered from a supply of the molten metal into contact with a chill surface at a casting station and the chill surface is driven for movement in a path past the casting station at a predetermined linear rate to quench and withdraw a continuous strip of metal from the molten metal supply, the strip having a bottom surface adhering to the chill surface and an unsolidified top surface as it is withdrawn from the molten metal supply, includes a top roll adjustably mounted above the chill surface and spaced therefrom by a distance substantially equal to the thickness of the strip desired with the top roll in contact with the unsolidified top surface of the strip, with the temperature of the top roll surface in contact with the unsolidified top surface of the strip being maintained at a level which will not solidify the top surface of the metal being cast.

28 Claims, 3 Drawing Sheets

APPARATUS FOR AND PROCESS OF DIRECT CASTING OF METAL STRIP

This is a continuation-in-part of copending application Ser. No. 152,486, filed Feb. 5, 1988, now abandoned.

BACKGROUND OF THE INVENTION

1. Field of the Invention

This invention relates to continuous direct casting of metal strip by a process employing a moving chill surface upon which molten metal is flowed for solidication beginning on the chill surface and progressing in a direction outwardly to the free top surface of the strip formed.

2. Prior Art

The advantages to be achieved in direct casting of molten metal into thin strip or sheet (hereinafter strip) on a continuous basis have long been recognized and numerous processes and apparatus have been proposed for the direct casting of metal strip. It is not believed, however, that any of these prior art processes or devices have been successfully used for use on a commercial basis, particularly for the production of a high quality strip suitable for use in the as-cast condition for the production of commercial products, or for further processing as by rolling or shaping by other means.

In the known prior art continuous or direct strip casting processes employing a continuously driven chill surface which contacts a melt of the metal to be cast, the melt is solidified by extracting heat through the chill surface so that a thin skin of the metal is solidified immediately upon contact with the chill. This skin grows in thickness as the chill moves progressively through or past the melt until the strip is completely formed. The thin skin initially formed is firmly adhered to the chill and this intimate bonded contact results in a maximum heat transfer from the melt to the chill.

As the solidifying skin progressively increases in thickness, the extraction of heat results in contraction of the solidifying strip at its bonded interface with the chill until the bond is broken, thereby resulting in a substantial reduction in the rate of heat extraction. The successful production of quality cast strip by such a process depends to a large degree upon the ability to extract heat at a uniform rate across the width of the strip to produce a uniform release of the cast product from the chill. One process for producing the uniform heat extraction through the chill surface is disclosed and claimed in copending U.S. patent application Ser. No. 885,718, assigned to the assignee of the present application, and involves establishing a natural oxide layer on the chill surface to provide an interface between the layer of molten metal and the chill surface and maintaining the natural oxide interface in a smooth layer of substantially uniform thickness.

In the production of directly cast strip on a chill, surface defects frequently occur in the top surface of the strip, i.e., the surface away from the chill. These defects may include surface cracks as well as variations in gauge or longitudinal shape of the strip and variations in transverse profile, making subsequent rolling or other processing of the cast strip difficult or impossible. Attempts have been made to control profile and gauge variations by contacting the top surface of the strip with a second chill roll prior to solidification of the top surface whereby the top roll cools and solidifies the top surface or skin of the strip and acts as a flow controller to limit the amount of molten metal deposited upon the chill. It is also known to contact the top surface with a pressure roll immediately after solidification of the strip in an attempt to control the strip gauge by a hot rolling action. Such pressure rolls have been internally cooled or otherwise configured to dissipate heat and provide a chilling effect on the strip.

U.S. Pat. No. 2,348,178 to J. M. Merle discloses, at FIGS. 1 and 4, means for flowing molten metal through a nozzle onto a continuous moving belt chill surface and a continuous cylindrical wheel chill surface, respectively. FIGS. 2, 8 and 9 of this patent disclose rolls 28 and 106 contacting the top surface of a stream of molten metal issuing from a nozzle in the bottom of a tundish, with the roll acting as a metering valve to control the size of the nozzle opening and hence the rate of flow of molten metal onto the chill surface. FIGS. 5 and 6 of this patent disclose the use of rolls 36 and **36*a* which act on the top surface of the formed, or solidified strip. All the rolls contacting the top surface, i.e., rolls 28, 36, 36*a* and 106** are preferably internally cooled as by flowing water therethrough so that the rolls aid in solidification of the molten metal. As indicated above, it is not believed that either the apparatus or process of the Merle patent have been successfully used for the production of directly cast strip on a commercial basis.

Japanese published patent application No. 1983-41656 (published Mar. 10, 1984) discloses apparatus for directly casting thin metal strip in which molten metal is supplied from a suitable source such as a ladle and maintained at a uniform level in an open tundish having one wall defined by a large cylindrical casting wheel which is internally cooled by a circulating cooling fluid. The casting wheel is rotated in a direction to move its surface in contact with the molten metal in the tundish upwardly while heat is extracted through the chill surface to progressively form a strip 9 having a thickness "T" as the strip emerges from the top of the molten metal pool in the tundish. A water cooled top roll 10 is positioned to engage the top surface of the solidified strip and reduce the strip to a thickness "t" by a hot rolling action. Liquid sprayed on the emerging strip assures a solidified top surface before contact with the top roll.

Published European patent application No. 198,669 (published Oct. 22, 1986) discloses apparatus for directly casting thin metal sheet in a continuous process employing a large chill roll positioned to have its outer surface contact molten metal in a tundish and driven to withdraw the solidifying strip adhered to its surface. A water cooled top roll is positioned to extend into the molten metal supply in the tundish and is driven at the same peripheral speed as the large chill roll but in the opposite direction so that molten metal is fed between the two rolls to emerge in a thin solid sheet which is then peeled from the large roll surface. A similar apparatus and process is disclosed in Japanese Patent 59-13551.

Difficulty has been encountered in attempting to use a top roll of the type disclosed in the prior art in contact with the formed or forming strip moving on a primary chill surface. For example, when a cooled top roll is employed in contact with molten metal as disclosed in the above-mentioned Japanese patent and the European patent application, there is a tendency for the top surface to solidify on contact with the chilled surface and to adhere to the surface in the same manner as the bottom strip surface adheres to the primary chill. Although this bond between the top strip surface and the cooled top roll may be only brief and broken more readily as a result of the relatively small radius of the top roll, cast sheet defects nevertheless result.

Attempts to form directly cast thin metal strip using a top roll engaging and rolling the top surface of the strip after solidification also have not proved successful. Although the just-formed and solidified strip is still extremely hot and soft when contacted with a top shaping roll, metal movement in such a rolling operation can essentially only be in the rolling direction, i.e., longitudinally of the formed strip, and therefore corrections of the transverse profile of the strip cannot be accomplished. Further, surface defects in the form of minute cracks may be formed prior to reaching the rolling operation, and rolling can result in propagating such cracks rather than eliminating them.

Attempts to shape the strip by a hot rolling operation immediately following solidification of the strip on the chill also results in forcing of the bottom surface of the soft strip into any grooves or other surface depressions employed on the chill surface. This not only produces an undesired surface configuration on the strip but also results in uneven and difficult release of the strip from the chill surface.

It is, accordingly, a primary object of the present invention to provide a novel process of and apparatus for producing directly cast thin metal strip in a high speed commercial operation.

Another object is to provide such a process and apparatus to produce a directly cast thin metal strip having an improved transverse profile and more uniform longitudinal shape.

Another object of the invention is to provide such a process and apparatus having a smooth uniform top surface substantially free from transverse cracks.

SUMMARY OF THE INVENTION

The foregoing and other features and advantages are achieved in accordance with the present invention wherein a melt of the metal to be cast is brought into contact with a continuously moving chill to solidify a strip of substantially uniform thickness on the chill surface, and the strip is removed from the chill after solidification is substantially complete. The chill may be an internally cooled cylindrical casting wheel and the process will be described herein with specific reference to apparatus using such a chill, it being understood that other chill configurations may also be employed.

The preferred embodiment of the invention described in detail hereinbelow employs a cylindrical chill positioned to effectively form one end wall of a tundish or other container for a melt of the metal to be cast and rotated in a direction to move the chill surface upwardly through and out of the melt.

As the continuous surface of the chill moves into contact with the molten metal in the tundish, a thin solid skin of metal immediately forms on and firmly adheres to the chill, with the thickness of this skin progressively increasing as it moves with the chill upwardly through the melt. A top roll positioned to have its surface in fixed spaced relation to the surface of the chill is supported for rotation about an axis parallel to the axis of the driven cylindrical chill. The top roll is positioned to engage liquid metal moving with the top of the solidified portion of the strip while avoiding any contact with the solidified portion of the strip. Preferably only a thin layer or film of molten metal passes beneath the top roll, and the top roll may be shaped to produce the desired cross sectional dimensions for the strip being formed.

In order to avoid solidification of the metal as a result of contact with the top roll, the roll is uncooled and preferably is maintained at a temperature at least equal to the lowest solidification temperature of the metal or alloy being cast. This assures freedom of the film of molten metal to move both longitudinally and transversely of the moving strip to produce a uniform, smooth top surface defined by the liquid film exiting the nip of the top roll. This thin film rapidly solidifies without further movement relative to the strip and results in a more uniform strip having a top surface sufficiently free of cracks and other defects for commercial use in the as-cast condition and for further processing.

BRIEF DESCRIPTION OF THE DRAWINGS

The foregoing and other features and advantages of the present invention will be apparent from the detailed description contained hereinbelow, taken in conjunction with the accompanying drawings, in which.

DESCRIPTION OF THE PREFERRED EMBODIMENT

Figure 1:
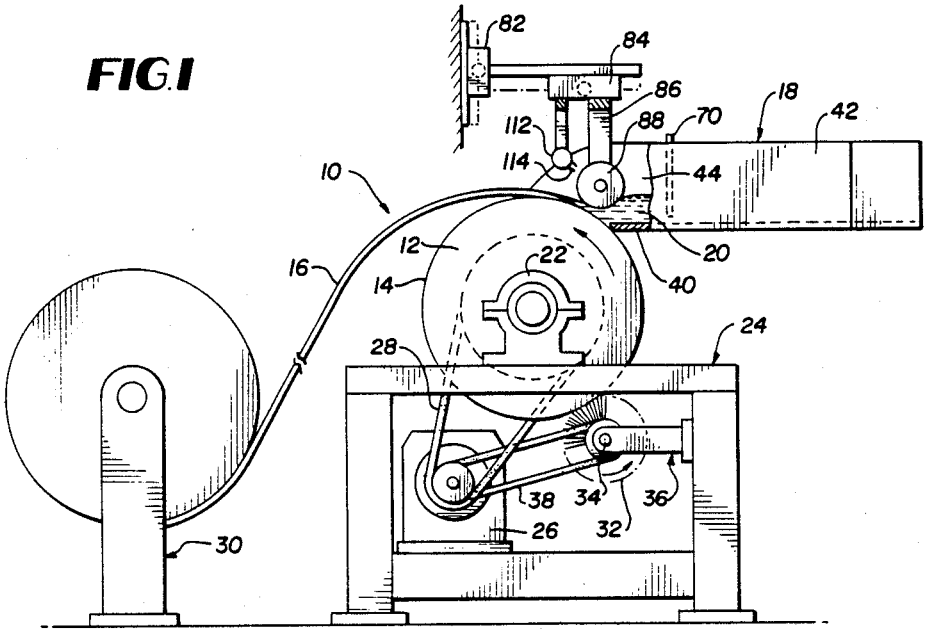
FIG. 1 is a schematic view, in elevation and partially in section, of a direct strip casting apparatus embodying the principles of the present invention.
Figure 2:
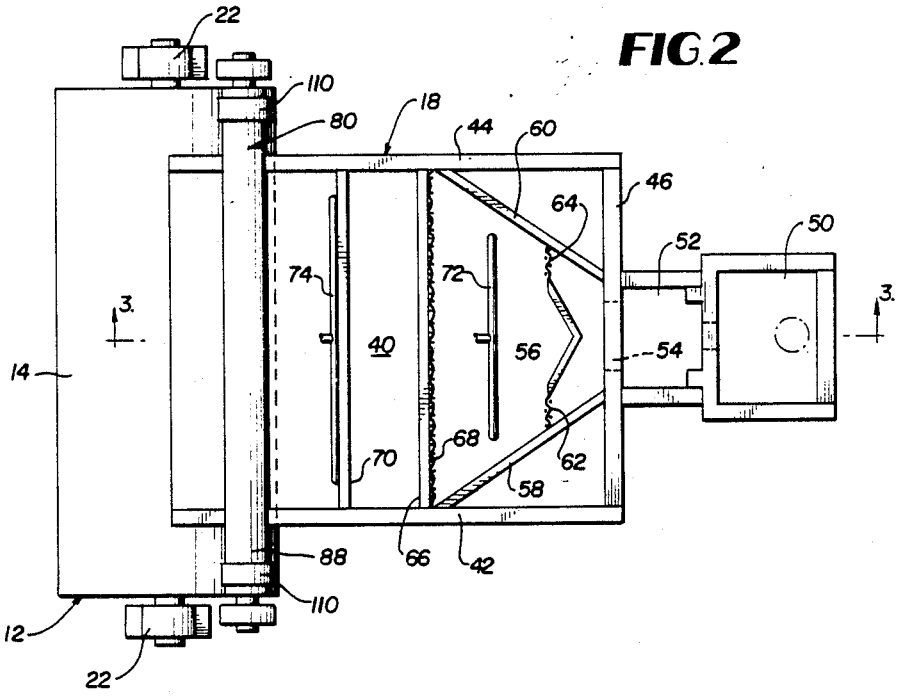
FIG. 2 is a plan view of a portion of the apparatus shown in FIG. 1.

Referring now to the drawings in detail, a melt drag strip casting apparatus suitable for use in the practice of the present invention is illustrated schematically in FIGS. 1 and 2 and designated generally by the reference numeral 10. The apparatus includes a chill 12 in the form of a cylindrical casting wheel or drum having a cooled cylindrical outer surface 14 upon which the metallic strip 16 is cast. A tundish assembly 18 is supported in close proximity to the casting wheel 12 in position to supply molten metal 20 contained therein at a uniform depth into contact with the chill surface 14.

Casting wheel 12 is internally cooled with circulating water or other cooling fluid which rapidly extracts heat through surface 14 to thereby quench and solidify liquid metal from the melt 20 as the casting surface 14 rotates upwardly through the melt in tundish 18. Internally cooled casting wheels are known and as such wheel 12 forms no part of the present invention. One example of a known internally cooled casting wheel is found in U.S. Pat. No. 2,348,178. Also, the outer surface 14 of the chill 12 is preferably grooved or roughened as shown for example in U.S. Pat. Nos. 3,345,738 and 4,250,950.

Suitable means such as journal bearings 22 support the chill 12 for rotation about a fixed horizontal axis on a rigid support frame indicated generally by the reference numeral 24. The chill is supported in close proximity to tundish 18, and suitable drive means such as a variable speed motor and reduction gear mechanism 26 and a drive chain or belt 28 illustrated schematically in FIG. 1 are provided to drive the chill about its fixed horizontal axis. A suitable coiling assembly of conventional design, illustrated schematically at 30, may be provided to continuously coil the strip 16 as it is discharged from the continuous casting assembly.

In order to maintain a uniform, polished, dense natural oxide coating on the chill surface 14, a rotary brush 32 is mounted for rotation on a shaft 34 having its longitudinal axis parallel to the axis of rotation of the chill 12. Brush 32 is supported by suitable brackets 36 and driven, as by belt 38, from motor and reduction gear assembly 26 to continuously engage and polish the surface 14. The brush assembly, and the polishing effect to maintain the uniform oxide coating on the surface 14 are described in detail in copending U.S. patent application Ser. No. 263,074, filed Oct. 27, 1988 and assigned to the assignee of the present invention.

Figure 3:
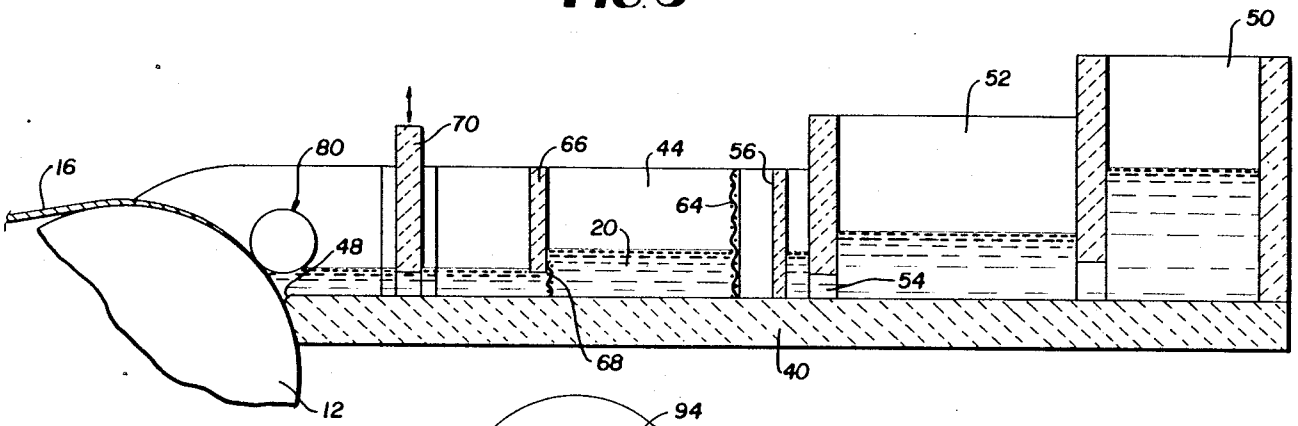
FIG. 3 is an elevation view, partially in section, taken along line 3—3 of FIG. 2.

As best seen in FIGS. 2 and 3, the tundish assembly 18 includes a floor 40 and laterally spaced, upwardly extending sidewalls 42, 44, a rear end wall 46 and an open exit end effectively closed by chill surface 14. Bottom wall 40 terminates at the open end of the tundish in a contoured lip 48 best seen in FIGS. 3 and 7. Molten metal is supplied to the tundish 18 from a receiving chamber 50 and level equalizing chamber 52 through a submerged inlet port 54 in end wall 46. Molten metal may be supplied to the receiving chamber 50 by any suitable means such as a ladle or a hot metal transfer system from a melting furnace.

Molten metal flowing into the tundish 18 through inlet opening 54 engages a central baffle 56 which is generally V-shaped in top plan view and which is disposed with the apex of the V directed toward and spaced from the inlet 54. Thus, molten metal flowing into the tundish is divided and diverted toward the sidewalls 42, 44 to minimize channeling and to produce a more uniform flow and temperature of metal reaching the chill surface 14. In order to eliminate stagnant flow areas in the rear corner portions of the tundish, a pair of diagonal walls 58, 60 extend between end wall 46 and sidewalls 42, 44 respectively, with the walls 58, 60 extending in outwardly diverging relation from the end wall 46. The lateral spaces between the extremities of the central baffle 56 and the adjacent diagonally extending walls 58, 60 are provided with filters 62, 64, respectively, in the form of screens which function to further equalize the flow of metal through the tundish toward lip 48.

A transverse dam or wall 66 extends between sidewalls 42 and 44 at a position downstream of the V-shaped baffle 56. Divider wall 66 has its bottom edge spaced above the top surface of bottom wall 40 and a submerged flow diffuser screen or filter 68 extends between the wall 66 and the bottom of the tundish to provide further flow equalization and distribution of the molten metal. The flow restriction provided by the filter or screen 68 normally results in the level of molten metal upstream of the divider wall 66 being above the top of the screen and above the level on the downstream side of the wall, thereby providing a positive head producing a generally uniform, diffused flow of molten metal through the screen throughout the full width of the tundish.

A movable flow control gate 70 is supported for vertical sliding movement in tundish 18 at a location between the divider wall 66 and lip 48 as best seen in FIG. 3. Gate 70 is guided in suitable channels on the inner surface of walls 42, 44 for movement between a raised casting position in which the gate is out of contact with the molten metal in the tundish and a lowered position in contact with the top surface of bottom wall 40 to stop the flow of molten metal to the open end of the tundish. If desired, as when casting highly reactive or easily oxidizable metals, a removable hood or cover (not shown) may be provided above the open top of the tundish and an atmosphere of inert gas such as nitrogen or argon supplied beneath the hood. For this purpose, a pair of gas distribution manifolds 72 and 74 may be provided in the tundish as shown in FIG. 2. A tundish of this general type is disclosed in U.S. patent application Ser. No 179,536, filed Apr. 8, 1988.

In accordance with the present invention, a top roll assembly 80 is supported for rotation about a horizontal axis parallel to the axis of chill 12 at a location near the top surface of the molten metal 20 in the tundish and the point of emergence from the melt of the strip of metal being cast during the casting operation. Mounting means is provided for supporting the top roll assembly for adjustment vertically and horizontally to adjust the axis of the roll 80 relative to the parallel axis of the chill 12. The adjustable mounting means for roll 80 is illustrated schematically in FIG. 1 as including a first slider block 82 mounted for rack and pinion adjustment in a vertical direction and a second slider block 84 supported for rack and pinion adjustment in a horizontal direction. A rigid bracket assembly 86 mounted on and projecting downwardly from slider block 84 journals the ends of roll assembly 80 for free rotation about its horizontal axis.

Figure 4:
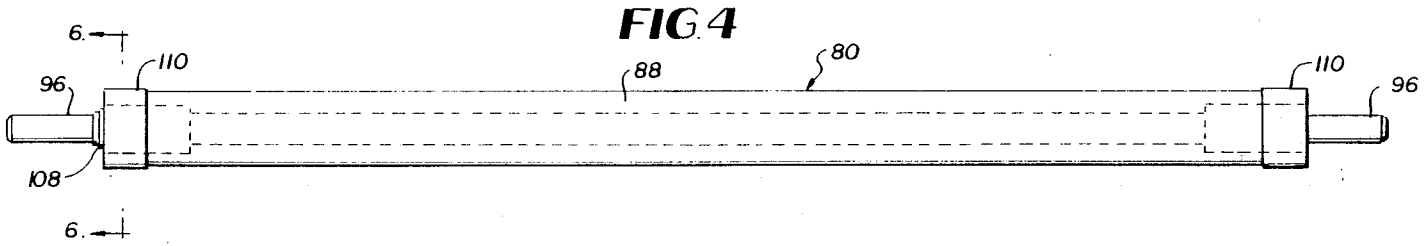
FIG. 4 is an elevation view of a top roll used with the apparatus of the present invention.
Figure 5:
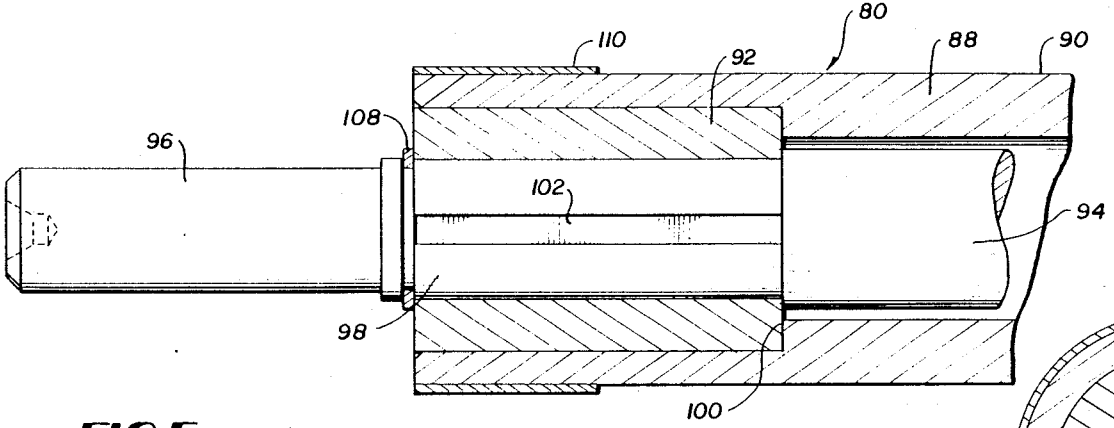
FIG. 5 is a sectional view, on an enlarged scale, of a portion of the roll shown in FIG. 4.
Figure 6:
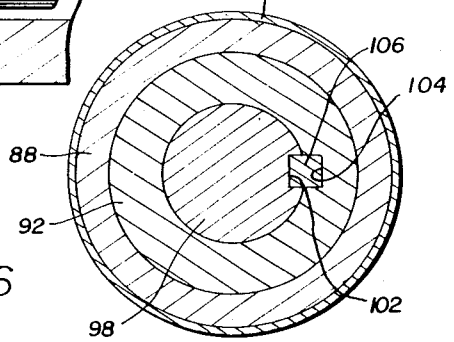
FIG. 6 is an enlarged sectional view taken along lines 6—6 of FIG. 4.

Referring to FIGS. 4, 5 and 6, a roll assembly which has been successfully used in practicing the present invention will be described in detail. As shown, the roll assembly 80 includes an elongated cylindrical tubular sleeve 88 having a smooth outer surface 90 for contacting molten metal moving with the strip being cast in the manner described more fully hereinbelow. Tubular sleeve 88 is provided with a counterbore at each end, forming a seat for receiving a short cylindrical bushing member 92, only one of which is shown in FIG. 4, it being understood that the other end of the roll assembly may be substantially identical to the end portion shown in FIG. 4.

The sleeve 88 and bushings 92 are supported on and keyed to an elongated shaft 94 for rotation therewith. Shaft 94 is provided with a reduced diameter bearing portion 96 adjacent each end, an intermediate diameter bushing support portion 98 spaced inwardly from the bearing sections 96, and a central portion of maximum diameter. A shoulder 100 at the juncture of the bushing support portion and central portion is adapted to engage the end of the bushings 92 when the bushings are installed in the sleeve 88 to axially fix the sleeve on the shaft. An elongated keyway 102 formed in the bushing support portion 96 and a corresponding elongated keyway in the bushings 92 cooperate to receive a key 106 (see FIG. 6) to fix the bushings 92 on the shaft 94 for rotation therewith.

Bushings 92 are permanently joined by a suitable high temperature bonding agent or other suitable means to the inner surface of the counterbore in the sleeve 88 so that the complete assembly rotates as a unit. One of the bushings 92 may be bonded in the end of sleeve 88 prior to assembly, with the second bushing 92 being inserted and bonded after assembly with the shaft 94. A suitable retaining ring 108 may be provided in position to engage the exposed end of the bushing 92 to permit handling of the assembly until bonding of the bushing and sleeve is completed.

Once the roll assembly 80 is completed, the outwardly projecting bearing sections 96 of shaft 94 are mounted in suitable bearings on the bracket 86, and the bracket is adjusted to accurately position the roll relative to the chill surface 14. The roll may be supported for free rotation or driven in the same rotational direction on the chill 12, but preferably is driven in a direction opposite to the chill. Also, the top roll will normally be driven at a rate such that the surface speed of chill surface 14 and roll surface 90 are substantially equal although different surface speeds may also be employed.

The top roll may be driven by various means, including providing a drive chain or belt engaging a suitable sprocket or pulley on the end of shaft 94, but in the preferred embodiment illustrated in FIG. 4, the top roll 80 is driven directly from the chill 12. To accomplish this, a thin annular metallic band or sleeve 110 is mounted, as by a shrink fit or bonding, on each end portion of the tubular sleeve 88. The radial thickness of the sleeve 110 is selected to correspond to the desired spacing between the surface 90 and chill surface 14 as described more fully hereinbelow. In this embodiment, the top roll is adjusted to urge the outer surface of the sleeves 110 into contact with the outer surface of the chill 12 with sufficient force so that rotation of the chill will drive the roll 80 through frictional contact with the sleeves 110.

As discussed above, it is critical to the present invention that the top roll not be cooled for the extraction of heat from the top surface of the strip being formed. Instead, successful operation in accordance with this invention requires contact of the top roll with liquid metal only, both from the standpoint of providing the desired substantially defect-free top surface and of enabling the necessary uniform release between the solidified strip and the chill surface. This is accomplished by maintaining the top roll at a temperature which will not cool the thin layer of molten metal sufficiently to solidify the top surface of the forming strip. The top roll may be maintained at this elevated temperature by contact with the molten metal alone or with the application of heat from an external source. Preferably, the top roll is preheated to the desired temperature before commencing the process. The minimum permissible temperature of the top roll will vary, of course, with numerous factors including the thermal conductivity of the top roll, the time of contact between the top roll and the molten metal, and the temperature of the molten metal at the point of contact with the top roll. Preferably, however, the top roll surface will be maintained at a temperature which is at least substantially equal to the minimum solidification temperature of the metal or alloy being cast.

The sleeve 88 should be formed from a material, or provided with a coating, which will not be wet by the molten metal to avoid a tendency of the molten metal to adhere to the surface of the top roll and disrupt the top surface of the strip being cast. One roll which has been successfully used employs an outer sleeve formed from graphite. A solid graphite cylinder may also be employed as a top roll.

In order to assure against the molten metal sticking to the top roll, a suitable release agent may be applied to the roll surface. In operation with a graphite roll, carbon black, or soot, has been applied by directing a stream of partially combusted hydrocarbon gas, for example, acetylene, onto the surface of the roll to deposit a thin coating of soot onto the roll on a continuous basis during casting. Such an arrangement is illustrated schematically in FIG. 1 and includes a manifold 112 extending substantially along the full length of the top roll in the area to be contacted with molten metal, and a burner nozzle, or series of nozzles 114 along the manifold 112 for directing a flow of combustible gas for combustion in contact with the roll surface 90. The gas may be selected to burn with a temperature to stabilize and maintain the surface temperature of the roll at the desired level while at the same time depositing a thin layer of carbon black onto the graphite surface to act as a release agent, thereby assuring that the liquid metal being cast will not adhere to the top roll. Alternatively, separate burners may be employed to apply heat and coat the top roll.

In order to initiate operation of the apparatus just described, it is possible to elevate the surface temperature of the roll 88 by contact with molten metal in the tundish until the necessary heat was absorbed by the top roll, but this method may result in the production of strip of inferior quality until the top roll reaches the desired elevated temperature. Accordingly, a preferred method of operation is to preheat the top roll to the necessary minimum temperature before commencing the casting operation.

Figure 7:
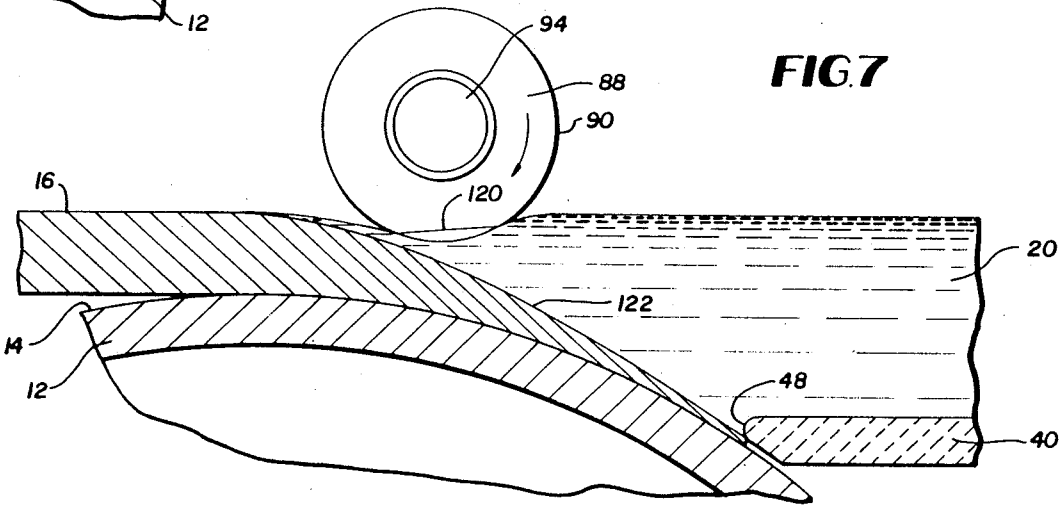
FIG. 7 is a diagrammatic showing, in section, of the flow of molten metal through the apparatus when practicing the present invention.

Operation of the direct casting apparatus and process provided by the present invention may be more fully understood from FIG. 7 of the drawings which is a diagrammatic showing of the interrelationship of the chill 12, the tundish 18 and the top roll 80. As background, the system of FIG. 7 with the top roll 80 out of contact with molten metal from the tundish, would operate in accordance with the teachings of the prior art. In particular, movement of the chill surface 14 in contact with a stream of molten metal from the tundish would effect immediate solidification of a thin film of the metal on the chill surface 16 and as the chill surface moves, solidification of molten metal will continue and affect total solidification of the strip shortly after it emerges from the melt 20 in the tundish 18. By use of a chill having grooves in its casting surface and controlling the oxide coating on the casting surface as discussed above, the lower surface of the strip thus produced is suitable for commercial operations. However, the top surface of the cast strip thus produced may include defects in the form of ripples and transverse cracks as well as variations in thickness, longitudinal shape and transverse profile and the overall strip may not be suitable for commercial sale or further commercial processing into suitable product.

As discussed above, the present invention provides a novel use of a top roll, i.e., a roll located above the chill surface, which overcomes the formation of ripples and transverse cracks and also aids in controlling shape, profile and thickness of cast strip. In practicing the present invention, the axis of rotation of the top roll is positioned relative to the top surface of the melt 20 to provide a segment of the top roll surface defined by chord 120, which projects into the bath 20 of molten metal. Thus, upon rotation of the top roll 80, this portion of the external cylindrical surface of the roll moves in continuous relation with the molten metal facing the segment; such molten metal comprising molten metal ultimately forming the top surface of the cast strip. Also, the axis of rotation of the top roll is located to position the path of movement of the top roll surface in the liquid metal above the liquid-solid interface 122. The top roll is positioned to locate the point of separation of the submerged surface portion and the liquid metal as close as practical to the point of total solidification of the strip while considering other requirements such as the desired thickness of the strip and avoiding contact of the top roll with the solidified portion of the strip. The adjusted position of the axis of rotation of the top roll may be obtained by adjusting the rack and pinion arrangements discussed above.

During operation of the process the chill surface 14 will continue to extract heat and affect solidification of the molten metal until the strip is completely solidified. To preclude solidification of the top surface in the region of the submerged surface of the top roll 80 it is critical that the top roll be an uncooled roll or a heated roll. As used herein, the term "uncooled" is intended to mean a roll which is not cooled to extract heat from the melt, but which is operated at a temperature which will not solidify the top surface of the strip and preferably at least equal to the minimum solidification temperature of the metal being cast. Thus, the molten metal contacting the submerged section of the roll surface will emerge and separate from the top roll while still in the liquid state. During operation, this emerging top surface on the strip can be observed as a shiny liquid surface which quickly solidifies after separation from contact with the top roll.

The final adjusted position of the top roll 80 for optimum operation will depend upon a number of parameters including the radius of the chill surface 14, the radius of the top roll sleeve 88, the speed of rotation of the chill surface, speed of rotation of the top roll, and the composition of the metal. It is important, however, that the spacing between the top roll surface and the chill surface 14 be such that at least a thin film of molten metal passes beneath the top roll on the top surface of the strip being formed.

It has been discovered that the longitudinal and lateral movement of the molten metal, due to the action of the uncooled or heated top roll on the molten metal in the region of the submerged top roll surface substantially eliminates ripples and transverse cracks in the top surface of the cast strip. Furthermore, it has been found that by permitting only a thin film of molten metal to pass beneath the top roll, this film is quickly solidified to provide more accurate control of the shape, profile and thickness of the cast strip.

The top roll may be contoured along its length to produce the desired gap between the top roll and the chill surface to thereby produce the desired strip cross sectional shape and to compensate for predetermined dimensional changes in the chill surface resulting from operational conditions. For example, depending on the intended use, it may be desirable to produce a strip with a uniform cross section or with a slight crown or increased thickness from the edges to the center.

As indicated above, the necessary operating temperature of the top roll may be obtained by applying an external source of heat as from a gas burner which may be continuously applied throughout the casting operation, or by preheating the top roll, or by establishing equilibrium conditions from extended contact with the melt. In any event, the top roll temperature is such that the top roll does not affect solidification of the molten metal and all contact between the top roll and the metal is with liquid metal. Thus, the metal that forms the top surface of the cast strip enables the top roll to produce both longitudinal and lateral movement of the molten metal when in contact with the submerged roll surface. This layer or film of molten metal is sufficiently thin to remain stable until it solidifies to form the top surface of the cast strip.

Apparatus of the type schematically shown in the drawings and capable of high speed operation for the production of commercial quality strip has been constructed and operated in accordance with the present invention. This apparatus includes a water cooled steel chill providing a casting surface having 44 generally circumferentially extending grooves per inch, a diameter of 27.635 inches, and a width of 42 inches, and a baffle type tundish substantially as shown in FIGS. 2 and 3 for receiving and flowing molten metal onto the chill surface. A rotatable nylon brush containing 500 grit carbide particles is mounted for rotation in contact with the chill surface to control the natural oxide surface of the chill. The top roll has a graphite external cylindrical surface 2.516 inches in diameter and 42 inches wide, with an external cylindrical ring 1.5 inches long overlying the roll surface at each end for contact with the chill surface to drive the top roll.

A natural gas burner is employed for applying heat to the top roll and a second burner adjusted for incomplete combustion of acetylene is provided to apply a release coating of soot to the top roll surface.

A number of runs have been made using the apparatus described to produce strip of aluminum alloy 3105. In one such run, the cylindrical rings on the top roll surface had a radial thickness of 0.065 inches. The position of the top roll was adjusted to engage the cylindrical rings with the chill surface to establish a 0.065 inch gap between the cylindrical rings of the top roll and the chill surface; the 0.065 inch ring thickness being the algebraic sum of the 0.045 desired strip thickness and the 0.020 inch reduction in the gap between the top roll and chill surface resulting from thermal expansion of the portion of the chill surface and of the top roll surface contacted by the molten metal.

When parameters of the process reached equilibrium, i.e., rate of flow of molten metal from the tundish, speed of rotation of the casting wheel and speed of rotation of the top roll the apparatus operated in the manner shown in FIG. 7 with the top roll operating at the necessary elevated temperature and with the top roll being in contact only with molten metal, the system was operated to produce continuously approximately 5,000 pounds of strip 30 inches wide in a period of 18.5 minutes. The strip had a substantially uniform thickness and transverse profile and the top surface was substantially free from cracks and other defects and was found to be of commercial quality.

Samples from the cast strip were measured to determine the variations in strip profile, i.e., variations in strip thickness transversely across the strip width, and strip shape, i.e., variations in thickness along the length of the strip The profile measurements were taken at two inch intervals across the strip and showed a variation in gauge of only 0.002 inches. The shape measurements were taken at one foot intervals and also showed a variation in gauge of only 0.002 inches. Casting speeds during this run were varied from 250 to 205 feet per minute About one-half of the coil of cast 3105 aluminum alloy strip just described was slit to remove one inch from each side of the strip, then rolled in a cold mill at speeds of up to 500 feet per minute.

While a preferred embodiment of the invention has been disclosed, it should be understood that the invention is not so limited but rather that it is intended to include all embodiments which would be apparent to one skilled in the art and which come within the spirit and scope of the invention.

What is claimed is:

1. In a melt drag metal strip casting apparatus wherein molten metal is delivered from a supply of the molten metal into contact with a chill surface at a casting station and the chill surface is driven for movement in a path past the casting station at a predetermined linear rate to quench and withdraw a continuous strip of metal from the molten metal supply, the strip having a bottom surface adhering to the chill surface and an unsolidified top surface as it is withdrawn from the molten metal supply, the improvement comprising, a top roll, mounting means supporting the top roll above the chill surface and spaced therefrom by a distance substantially equal to the thickness of the strip desired, and in contact with the unsolidified top surface of the strip, means independent of the molten metal for applying heat to the top roll to maintain the top roll temperature at a level which will not solidify the top surface of the strip as a result of contact with the top roll, and means withdrawing the solidified layer as a continuous metal strip.

2. Apparatus for direct casting of molten metal as defined in claim 1 in which the means for heating the top roll includes means for applying heat to the surface of the top roll from an external source.

3. Apparatus for direct casting of molten metal as defined in claim 2 in which the means for heating the top roll includes means for substantially continuously applying heat to the top roll during flow of the molten metal onto the chill surface.

4. Apparatus as defined in claim 2 further comprising means for rotating the top roll at a surface speed substantially equal to the speed of said chill surface.

5. Apparatus as defined in claim 1 further comprising means driving said top roll at a surface speed different than the speed of said chill surface.

6. Apparatus as defined in claim 1 further comprising means for rotating the top roll at a surface speed substantially equal to the speed of said chill surface.

7. Apparatus as defined in claim 1 wherein said top roll has an outer surface contoured to provide a substantially uniform gap between the top roll and chill surface along the full width of the strip being cast.

8. Apparatus as defined in claim 1 wherein said top roll has an outer surface contoured to provide a non-uniform gap between the top roll and the chill surface along the width of the strip being cast.

9. Apparatus as defined in claim 1 wherein said chill surface comprises the substantially cylindrical external surface of an internally cooled casting wheel driven for rotation about a horizontal axis, and wherein said means driving said top roll comprises means rotating said top roll about an axis parallel to the axis of said casting wheel in a direction opposite to the direction of rotation of said casting wheel and at a surface speed substantially equal to the surface speed of said chill surface.

10. Apparatus as defined in claim 9 wherein said top roll has an outer surface contoured to provide a substantially uniform gap between the top roll and chill surface along the full width of the strip being cast.

11. Apparatus as defined in claim 9 wherein said top roll has an outer surface contoured to provide a non-uniform gap between the top roll and the chill surface along the width of the strip being cast.

12. Apparatus for direct casting of molten metal as defined in claim 9 in which the means for heating the top roll includes means for applying heat to the surface of the top roll from an external source.

13. Apparatus as defined in claim 9 wherein said top roll comprises an elongated cylindrical body of graphite material defining the outer surface of the top roll which contacts the molten metal on the moving chill surface.

14. Apparatus as defined in claim 13 wherein said graphite body comprises an elongated hollow graphite sleeve, said top roll further comprising an elongated metal shaft extending through and supporting said graphite sleeve for rotation therewith about a common axis.

15. In a melt drag strip casting apparatus wherein molten metal is delivered from a supply of the molten metal into contact with a chill surface at a casting station and the chill surface is driven for movement in a path passed the casting station at a predetermined linear rate to quench and withdraw a continuous strip of metal from the molten metal supply, the strip having a bottom surface adhering to the chill surface and an unsolidified top surface as it is withdrawn from the molten metal supply, and a top roll mounted above the chill surface and spaced therefrom a distance substantially equal to the thickness of the strip desired for contact with the unsolidified top surface of the strip, the improvement wherein said top roll comprises an elongated cylindrical graphite body having a smooth outer surface for engaging the unsolidified metal on the top surface of a metal strip emerging from the supply of molten metal, and means supporting said graphite body for rotation about a horizontal axis parallel to and spaced from the top surface of the metal strip.

16. Apparatus defined in claim 15 wherein said graphite body comprises an elongated hollow graphite sleeve, and wherein said means supporting said graphite body comprises metal shaft means projecting outwardly from the ends of said graphite sleeve to define bearing sections adapted to be supported in bearings, and means joining said sleeve and said shaft means for rotation together about a common axis.

17. A process for direct casting of metal strip comprising withdrawing molten metal from an open tundish on a moving chill surface and progressively solidifying the metal from the moving chill surface upward to form a solid continuous strip, providing an uncooled top roll having an outer surface in contact with molten metal moving with the moving chill surface and having its axis spaced from the chill surface to define a gap between the top roll outer surface and the chill surface corresponding to the thickness of the strip to be formed, and rotating the top roll about its axis in contact with the molten metal.

18. The process defined in claim 17 wherein said moving chill surface is the outer cylindrical surface of an internally cooled chill wheel, and including rotating the top roll and the chill wheel in opposite directions about spaced parallel axes.

19. The process defined in claim 18 including rotating the top roll and the chill wheel at rates to produce substantially equal surface speeds.

20. The process defined in claim 19 including applying heat to the top roll from a source other than the molten metal being cast to maintain the top roll surface at a temperature which will not solidify the top surface of the molten metal on the moving top roll surface.

21. The process defined in claim 20 including providing a top roll surface contoured to cooperate with the chill wheel surface to provide a substantially uniform gap therebetween across the full width of the strip being formed.

22. The process defined in claim 20 including providing a top roll surface contoured to cooperate with the chill wheel surface to provide a non-uniform gap therebetween across the full width of the strip being formed.

23. The process defined in claim 21 including providing a gap between said top roll surface and said chill surface having a greater thickness near the center of the gap than at its ends.

24. A process for direct casting of metal strip comprising, providing a cooled continuous chill surface, providing a supply of molten metal and bringing the molten metal from the supply into contact with a predetermined area of the chill surface at a casting station, quenching the molten metal contacting the chill surface by extracting heat therefrom through the chill surface to solidify a strand of metal of predetermined thickness, driving the chill surface in a continuous path at a predetermined rate past the casting station to withdraw from the molten metal supply the solidified strand and a layer of molten metal adhering to the exposed surface of the strand, providing an uncooled top roll and supporting said uncooled top roll for rotation about a horizontal axis, contact the molten metal adhering to said exposed surface with said uncooled top roll and driving said roll for rotation about a horizontal axis to limit the thickness of the molten metal passing thereunder with the solidified strand, and maintaining the temperature of the top roll surface in contact with the unsolidified molten metal at a temperature at least substantially equal to the minimum solidification temperature of the metal being cast.

25. The process defined in claim 24 further comprising the steps of applying heat to the surface of said top roll from a source other than the molten metal during the casting operation.

26. The process defined in claim 25 further comprising the steps of continuously supplying a coating of release material to the surface of the top roll during casting.

27. The process defined in claim 25 wherein said moving chill surface is the outer cylindrical surface of an internally cooled chill wheel, and including rotating the top roll and the chill wheel in opposite directions about spaced parallel axes.

28. The process defined in claim 27 including providing a top roll surface contoured to cooperate with the chill wheel surface to provide a substantially uniform gap therebetween across the full width of the strip being formed.

* * * * *